United States Patent [19]

Robertson et al.

[11] 4,291,736

[45] Sep. 29, 1981

[54] MAGNETIC HAMMER

[75] Inventors: Alan D. Robertson; Blythe J. Robertson, both of 2808 Tradewinds Trail, Orlando, Fla. 32805; Gerald Olson, Pearland, Tex.

[73] Assignees: Alan D. Robertson; Blythe J. Robertson, both of Orlando, Fla.

[21] Appl. No.: 58,857

[22] Filed: Jul. 19, 1979

[51] Int. Cl.[3] ..... B25C 1/00; B25D 1/00

[52] U.S. Cl. ..... 145/30 A

[58] Field of Search ..... 145/30 A

[56] References Cited

U.S. PATENT DOCUMENTS

| | | | |
|---|---|---|---|
| 2,671,483 | 3/1954 | Clark | 145/30 A |
| 2,788,815 | 4/1957 | D'Aoust | 145/30 A |
| 4,073,327 | 2/1978 | Pearson | 145/30 A |

FOREIGN PATENT DOCUMENTS

| | | | |
|---|---|---|---|
| 920921 | 2/1973 | Canada | 145/30 A |

*Primary Examiner*—Stephen G. Kunin
*Assistant Examiner*—J. T. Zatarga
*Attorney, Agent, or Firm*—Duckworth, Hobby, Allen, Dyer & Pettis

[57] ABSTRACT

A magnetic hammer having a handle and a hammer body coupled to the handle includes a cylindrical magnetic insert having first and second ends with the magnetic poles of the insert being aligned with the central axis of the insert. A cylindrical retainer having first and second ends includes a cylindrical chamber which is sized to receive and retain the magnetic insert. The axis of the magnetic insert is aligned with the axis of the cylindrical retainer and the first end of the magnetic insert and the first end of the cylindrical retainer form the hammering face of the hammer. The second end of the cylindrical retainer is coupled to the hammer body.

11 Claims, 6 Drawing Figures

MAGNETIC HAMMER

BACKGROUND OF THE INVENTION

1. Field of the Invention

The present invention relates to magnetic hammers, and more particularly, to magnetic hammers having a cylindrical magnet assembly forming a substantial part of the hammering face of the hammer.

2. Description of the Prior Art

The prior art includes numerous different hammer configurations which include magnetic inserts for magnetically securing nails to the face of the hammer during nailing operations.

U.S. Pat. No. 2,671,483 (Clark) discloses a magnetic hammer which includes a cylindrical magnetic cap having a steel insert located on the central axis of the cap. A cylindrical magnet is positioned within a cylindrical aperture in the body of the hammer in alignment with the steel insert. A rubber disc is provided at the rear of the magnetic insert to cushion the magnetic insert during hammering operations. U.S. Pat. No. 2,482,909 (Hertz) discloses a magnetic hammer having a cross-shaped recess in the hammer face and a magnetized metallic head.

U.S. Pat. No. 2,788,815 (D'Aoust) discloses a hammer having a pair of magnets disposed about the center of gravity of the hammer head for magnetizing the entire hammer head assembly to assist in placing nails.

U.S. Pat. No. 2,731,993 (Mount) discloses a magnetic hammer having a cylindrical magnetic insert positioned within a cylindrical passageway behind the face of the hammering surface.

U.S. Pat. No. 710,615 (Robertson) discloses a magnetic tack hammer which includes a split pole magnet on the rear tack starting surface of the magnetic hammer.

U.S. Pat. No. 29,760 (Boeklen) discloses a hammer having a ferromagnetic head which is magnetized during the manufacturing procedure.

U.S. Pat. No. 3,580,312 (Hallock) discloses a magnetic hammer including a pair of cylindrical magnets which are disposed in parallel alignment within the face of the hammer and which are oriented to reinforce one another to form a U-shaped magnetic assembly.

U.S. Pat. No. 2,864,417 (Scholten) discloses a magnetic hammer including a pair of parallel oriented magnets in the rear face of the hammer. These magnets are coupled together to form a single U-shaped magnet for magnetically securing nails and tacks to the rear face of the hammer. Austrian Pat. No. 235767 (Voytjech) discloses a related hammer embodiment.

U.S. Pat. No. 418,539 (Stock) discloses a hammer having a magnetized hammering face and notches in the rear portion of the hammering face for magnetically securing nails in predetermined positions during the initial stages of nailing.

U.S. Pat. No. 2,597,876 (Kurkjian) discloses a magnetic nail-holding hammer which includes a notch in a magnetized hammering face for securing nails during the initial nailing procedure. U.S. Pat. No. 3,543,821 (Johnson) discloses a hammer having a magnetic nail holder positioned above the hammer body. U.S. Pat. No. 1,477,833 (Leak) discloses a combination tool having a magnet positioned below the body of the hammer for securing a nail. U.S. Pat. No. 3,763,906 (Crowder) discloses a non-magnetic hammer having multiple notches for securing nails during the initial nailing procedure.

U.S. Pat. Nos. 3,721,282 (Hayes), 1,737,646 (Cummins), and 1,792,153 (Evich) disclose various other types of non-magnetic hammers having removable hammer faces.

SUMMARY OF THE INVENTION

The present invention contemplates a magnetic hammer having a handle and a hammer body which includes a flat face. The magnetic hammer comprises a cylindrical magnetic insert having first and second ends and magnetic poles which are aligned with the axis of the cylindrical insert. A cylindrical retainer includes a cylindrical chamber which is sized to receive and retain the magnetic insert. The axis of the magnetic insert is aligned with the axis of the cylindrical retainer while the first end of the magnetic insert and the first end of the cylindrical insert form the hammering surface of the hammer. Means is provided for securing the second end of the cylindrical retainer to the hammer body.

An important aspect of the present invention is the provision of a single cylindrical magnet which includes a single magnetic pole in the face of the hammer for drawing nails directly to the center of the hammering surface.

An additional important aspect of the present invention is the provision of a single cylindrical magnet which forms the central portion of the hammering surface of the hammer and which firmly magnetically secures nail heads to the center of the hammering surface.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
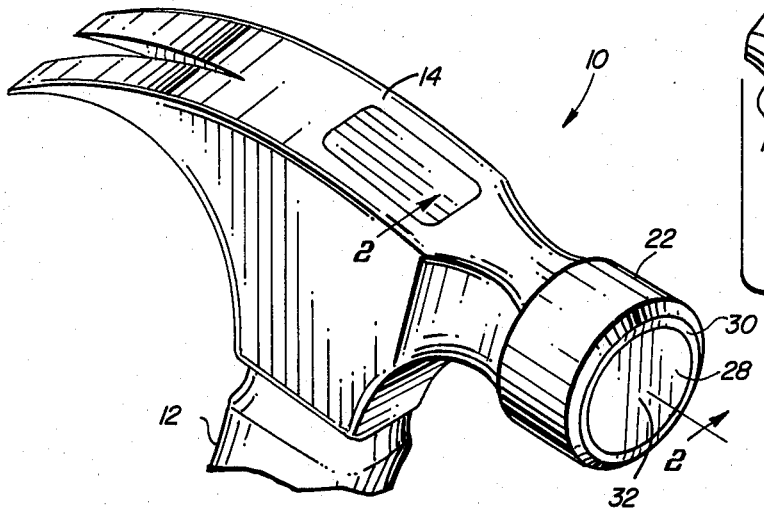
FIG. 1 illustrates one embodiment of the present invention shown in a perspective view.
Figure 3:
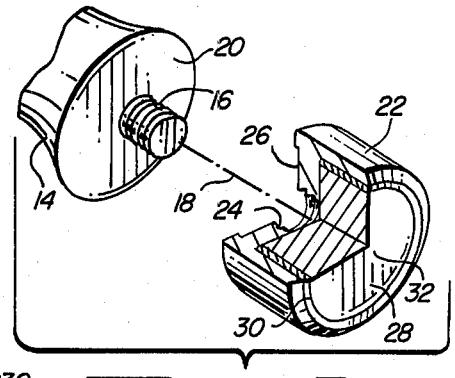
FIG. 3 is an exploded view of the hammering area of one embodiment of the present invention.
Figure 4:
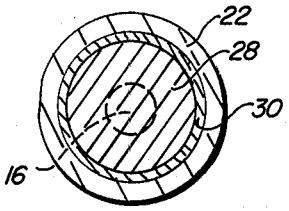
FIG. 4 is a sectional view, taken along section line 4—4, of the magnetic hammer illustrated in FIG. 2.
Figure 2:
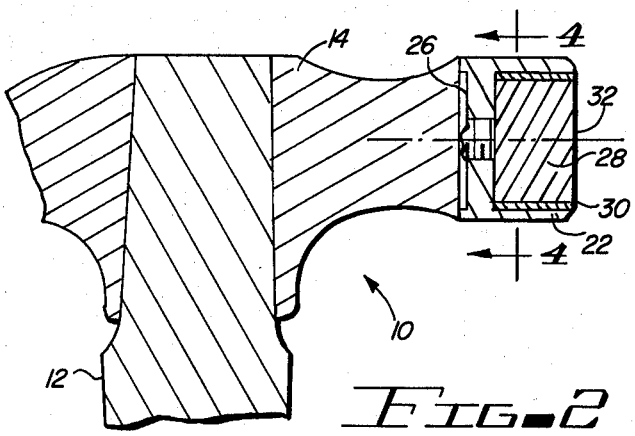
FIG. 2 is a sectional view of the magnetic hammer illustrated in FIG. 1, taken along section line 2—2.

Referring now to FIGS. 1, 2 and 3, one preferred embodiment of the invention will now be described in some detail. Magnetic hammer 10 includes a handle 12 to which hammer body 14 is coupled. Handle 12 and hammer body 14 are of conventional configuration, except that the hammer head of hammer body 14 has been removed either during manufacture of by machining away the hammer head on a lathe. During the manufacture or lathe cutting procedures, a male threaded shaft 16 is fabricated in alignment with the central axis 18 of the hammer head and extends from flat face 20 of hammer body 14.

A cylindrical retainer 22 has a $1\frac{1}{4}$ inch outer diameter and includes a $\frac{1}{4}$ inch diameter threaded passageway 24 which extends into the rear surface of retainer 22 in alignment with longitudinal axis 18. In one embodiment of the present invention, passageway 24 is 5/16 of an inch deep and is threaded with number 20 threads to match the threads on shaft 16. A 0.010 to 0.015 inch counter bore 26 is cut into the rear face of cylindrical retainer 22. The length of the side surface of cylindrical retainer 22 is approximately $\frac{3}{4}$ inch in the embodiment depicted in FIG. 1.

A cylindrical magnetic insert 28 is pressed into a non-magnetic spacer ring 30 which is manufactured from a material such as stainless steel. The assembly including magnetic insert 28 and spacer ring 30 is press fitted into the cylindrical chamber formed in the outer end of cylindrical retainer 22. Magnetic insert 28 is manufactured from Alnico V magnetic material and includes a pair of magnetic poles aligned with axis 18. One of the magnetic poles of magnetic insert 28 is positioned in the center of outer surface 32 of magnetic insert 28.

Figure 6:
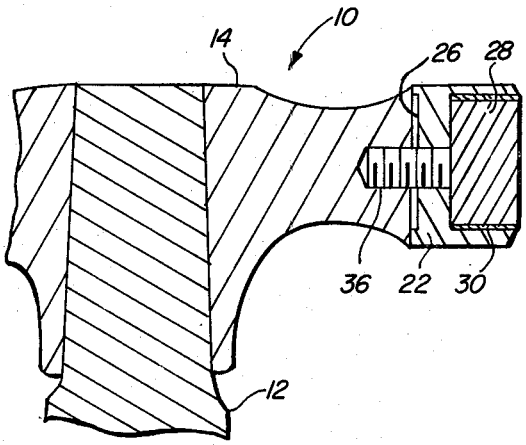
FIG. 6 is a sectional view of the magnetic hammer illustrated in FIG. 5, taken along section line 6—6.
Figure 5:
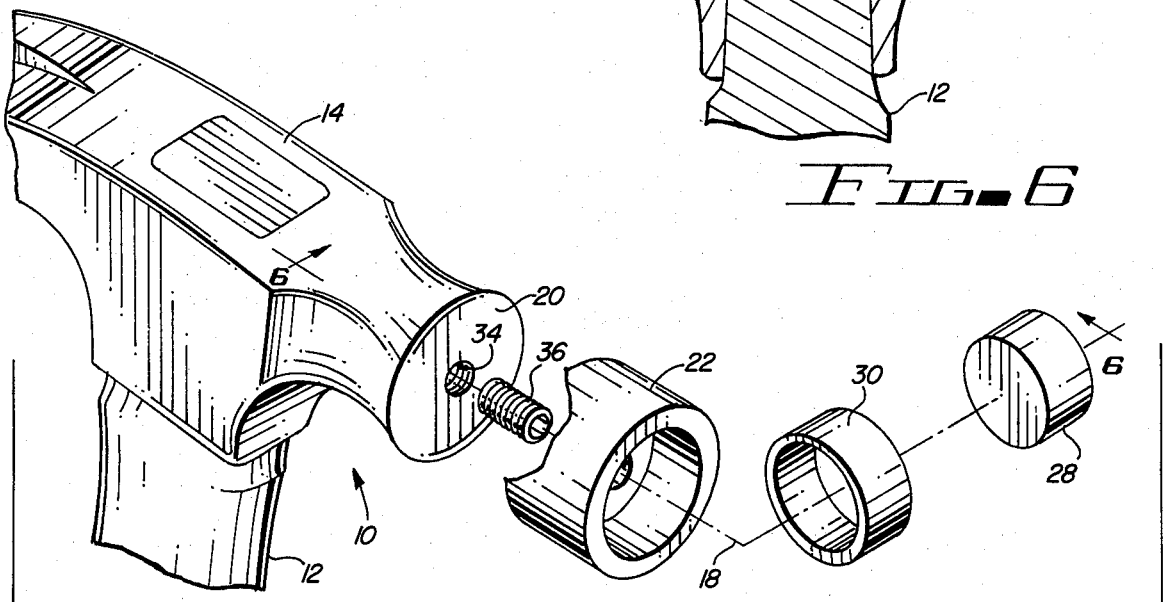
FIG. 5 is an exploded perspective view of another embodiment of the present invention.

A second embodiment of the present invention is illustrated in FIGS. 5 and 6. In this embodiment, a $\frac{1}{4}$ inch diameter by 5/16 inch deep threaded passageway 34 is bored into face 20 of hammer body 14. Number 20 threads are tapped into this threaded passageway. Cylindrical retainer 22 includes the same threaded passageway discussed in connection with the previous illustration such as FIG. 3.

In this second embodiment cylindrical retainer 22 is secured to threaded passageway 34 and face 20 of hammer body 14 by a $\frac{1}{4}$ inch diameter by $\frac{1}{2}$ inch long Allen socket screw 36 having number 20 threads.

The magnetic head assembly comprising cylindrical retainer 22, spacer ring 30 and cylindrical magnetic insert 28 is commercially available from Permag Southwest Corporation of Dallas, Texas and is designated by part no. PM-095-3 (Code 331) for the $1\frac{1}{4}$ inch diameter assembly discussed above. For use in connection for a smaller hammer, a one inch diameter magnetic head assembly is available from the same source and is designated by part no. PM-094-3 (Code 331). Cylindrical spacer 22 may be manufactured either from iron or from stronger heat treated tempered iron.

During the assembly procedure commercially available metal to metal adhesive such as Loc-Tight adhesive is applied to face 20 of hammer body 14 and to the rear surface of cylindrical retainer 22, including counter bore 26. The magnetic head assembly is then mounted to hammer body 14 and is torqued to approximately 15 foot-pounds. The metal surfaces which have thus been joined together can be smoothed by filing if desired.

The alnico magnet used in connection with the present invention provides a holding force of approximately 16 pounds. As a result of this extremely strong magnetic force and as a result of the characteristic that only a single magnetic pole is positioned at center 32 of magnetic insert 28, the head of a nail is generally drawn directly and accurately to the center of the hammer face when an individual using the hammer places the face of the hammer in proximity to the head of a nail. Nails of various sizes, including 8 to 10 inch long gutter nails, can be held centered upon the face of the magnetic hammer of the present invention.

Numerous advantages are realized by anyone who utilizes the present invention. As an example, in roofing work, a roofer's nailing radius is approximately 18 inches using prior art techniques which requires two hands to hold a nail while simultaneously hammering it. By using the present invention, a roofer is able to fully extend an arm holding a hammer having a nail which is magnetically secured to the face of the hammer. This permits a doubling of the nailing radius for a roofer and effectively quadruples the effective area he can nail without moving and substantially increases the rate at which he can apply shingles to a roof. Roofing operations are also substantially expedited since the initial nail setting blow can be done with great forces as a result of the extremely high magnetic force applied to a nail by magnetic insert 28. Generally two hammer strokes can be used to drive home a single nail.

The highly accurate self-centering mechanism provided by the magnetic hammer of the present invention and the various other advantages discussed above permit a roofer to virtually double his productivity. Other advantages such as increased safety can be realized since one who uses the present invention does not have to hold nails with his fingers. Since cylindrical retainer 22 and spacer ring 30 serve as magnetic keepers, magnetic insert 28 maintains its powerful magnetic force for a virtually unlimited time. This magnetic force is not substantially diminished by use and the extremely strong impacts incurred during use.

It will be apparent to those skilled in the art that the disclosed magnetic hammer may be modified in numerous ways and may assume many embodiments other than the preferred forms specifically set out and described above. Accordingly, it is intended by the appended claims to cover all such modifications of the invention which fall within the true spirit and scope of the invention.

We claim:

1. A magnetic hammer comprising:

a. a handle;

b. a hammer body attached to the handle and including a flat face;

c. a cylindrical magnet insert having first and second ends and first and second magnetic poles aligned with the axis of said magnet insert;

d. a cylindrical retainer having a first end, a second end and a threaded aperture in the second end, and including a cylindrical chamber sized to receive and retain said magnet insert, the longitudinal axis of said magnet insert being aligned with the longitudinal axis of said cylindrical retainer, and the first end of said magnet insert forming the hammering face of said hammer; and e. means for securing the cylindrical retainer to the hammer face comprising a threaded shaft solid throughout its entirety extending outwardly from the center of and perpendicular to said flat face for mating with the threaded aperture in the second end of said cylindrical retainer for securing the second end of said cylindrical retainer to the flat face of said hammer body.

2. The magnetic hammer of claim 1 wherein said securing means further includes an adhesive disposed upon the flat face of said hammer body and upon the second end of said cylindrical insert.

3. The magnetic hammer of claim 1 wherein said magnet insert includes an alnico magnet.

4. The magnetic hammer of claim 1 wherein said cylindrical retainer mechanically retains said magnet insert.

5. The magnetic hammer of claim 4 wherein the diameter of said magnet insert is substantially equal to the diameter of the cylindrical chamber of said cylindrical retainer.

6. The magnetic hammer of claim 1 wherein said magnet insert includes a cylindrical, non-magnetic spacer surrounding a cylindrical magnet.

7. A magnetic hammer comprising:

a. a handle;

b. a hammer body attached to the handle and including a flat face;

c. a cylindrical magnet insert having first and second ends and first and second magnetic poles aligned with the axis of said magnet insert;

d. a cylindrical retainer having a first end, a second end and a threaded aperture in the second end, and including a cylindrical chamber sized to receive and retain said magnet insert, the longitudinal axis of said magnet insert being aligned with the longitudinal axis of said cylindrical retainer, and the first end of said magnet insert forming the hammering face of said hammer; and e. means for securing the cylindrical retainer to the hammer face comprising:

(i) a threaded passageway in the flat face of said hammer body oriented perpendicular to the face of said hammer body; and (ii) a threaded shaft solid throughout its entirety and having a first end secured to the threaded aperture in said cylindrical retainer and a second end secured to the threaded passageway in the flat face of said hammer body, whereby the second end of said cylindrical retainer is tightly secured to the face of said hammer body by said threaded shaft.

8. The magnetic hammer of claim 7 wherein said magnet insert includes an alnico magnet.

9. The magnetic hammer of claim 7 wherein said cylindrical retainer mechanically retains said magnet insert.

10. The magnetic hammer of claim 9 wherein the diameter of said magnet insert is substantially equal to the diameter of the cylindrical chamber of said cylindrical retainer.

11. The magnetic hammer of claim 7 wherein said magnet insert includes a cylindrical, non-magnetic spacer surrounding a cylindrical magnet.

* * * * *